United States Patent [19]

Otto et al.

[11] 4,124,103

[45] Nov. 7, 1978

[54] ELEVATOR SYSTEM

[75] Inventors: Paul R. Otto, Marlboro; William N. Leang, Randolph Township, Morris County, both of N.J.

[73] Assignee: Westinghouse Electric Corp., Pittsburgh, Pa.

[21] Appl. No.: 775,808

[22] Filed: Mar. 9, 1977

[51] Int. Cl.[2] ..... B66B 3/02

[52] U.S. Cl. ..... 187/29 R

[58] Field of Search ..... 187/29; 340/19, 21

[56] References Cited

U.S. PATENT DOCUMENTS

| | | | |
|---|---|---|---|
| 3,750,850 | 8/1973 | Winkler et al. | 187/29 |
| 3,995,719 | 12/1976 | Mandel et al. | 187/29 |
| 4,009,766 | 3/1977 | Satoh | 187/29 |

*Primary Examiner*—Robert K. Schaefer
*Assistant Examiner*—W. E. Duncanson, Jr.
*Attorney, Agent, or Firm*—D. R. Lackey

[57] ABSTRACT

An elevator system including an elevator car and electrical control for operating same. Capacitors continue to energize a car movement detector in the electrical control following an interruption in the electrical power supply, to enable any movement of the elevator car following such interruption to be detected and stored. A stored indication of car movement following an interruption in the electrical power supply is used to correct a car position device in the electrical control.

7 Claims, 3 Drawing Figures

ELEVATOR SYSTEM

BACKGROUND OF THE INVENTION

1. Field of the Invention

The invention relates in general to elevator systems, and more specifically to arrangements for retaining an accurate indication of the position of an elevator car in an elevator system, notwithstanding an interruption in the associated electrical power supply.

2. Description of the Prior Art

A floor selector for an elevator car which utilizes a mechanical model of the elevator system is driven by the elevator car via a mechanical link. Thus, an interruption of the electrical power supply does not affect the accuracy of the floor selector. It continues to indicate the correct location of the elevator car in the building.

While this electromechanical type of floor selector provides excellent results, it is being replaced by solid-state floor selectors which are more accurate and easier to maintain. U.S. Pat. No. 3,750,850 , which is assigned to the same assignee of the present application, discloses a floor selector of the solid-state type. In a solid-state floor selector, the position of the elevator car is stored in memory elements, such as a binary counter, with car movement detectors updating the count of the counter to accurately indicate the address or location of the elevator car in the building. The address stored in the counter is compared with the addresses of the floors and the locations of calls for elevator service to create signals for operating and stopping the elevator car at the correct floors.

A disadvantage of the solid-state floor selector is the fact that the conventional solid-state memory devices are volatile. Removal or interruption of the electrical power supply causes the memory devices to lose the information stored therein. Thus, when electrical power returns, following an interruption, the floor selector has "lost" the car. The floor selector no longer knows where the elevator car is located in the building. Latching relays for retaining the car address at the time of power interruption do not account for car movement after power interruption. For example, a car moving at 500 feet per minute at the time of power interruption, will slide for up to 3 seconds before coming to a stop. Batteries for powering the car position circuits of the floor selector are costly, unreliable, and they present maintenance and replacement problems. The hereinbefore mentioned U.S. Pat. No. 3,750,850 resets the floor selector after power returns by causing the car to travel to the lower terminal where the address of the lower terminal is loaded into the car position counter. It would be desirable to be able to reset a solid-state floor selector, however, without the necessity of sending the car to a terminal floor, and without utilizing batteries to energize the car position circuits during a power interruption.

SUMMARY OF THE INVENTION

Briefly, the present invention is a new and improved elevator system including an elevator car mounted in a building to serve the floors therein, and electrical control for operating the elevator car. The electrical control includes a car movement detector and a floor selector which includes a solid-state car position indicator, such as a binary counter. The car movement detector updates the car position device to correctly indicate the position of the elevator car as it moves through the building. Capacitors are connected to energize the car movement detector, and a memory device responsive thereto, following an interruption in the electrical power supply. This arrangement enables movement of the elevator car following a power interruption to be detected and stored in the memory device. The memory device is used to correct the car position device following return of electrical power, if the elevator car moves following the interruption of electrical power.

BRIEF DESCRIPTION OF THE DRAWINGS

The invention may be better understood, and further advantages and uses thereof more readily apparent, when considered in view of the following detailed description of exemplary embodiments, taken with the accompanying drawings in which.

DESCRIPTION OF PREFERRED EMBODIMENTS

Figure 1:
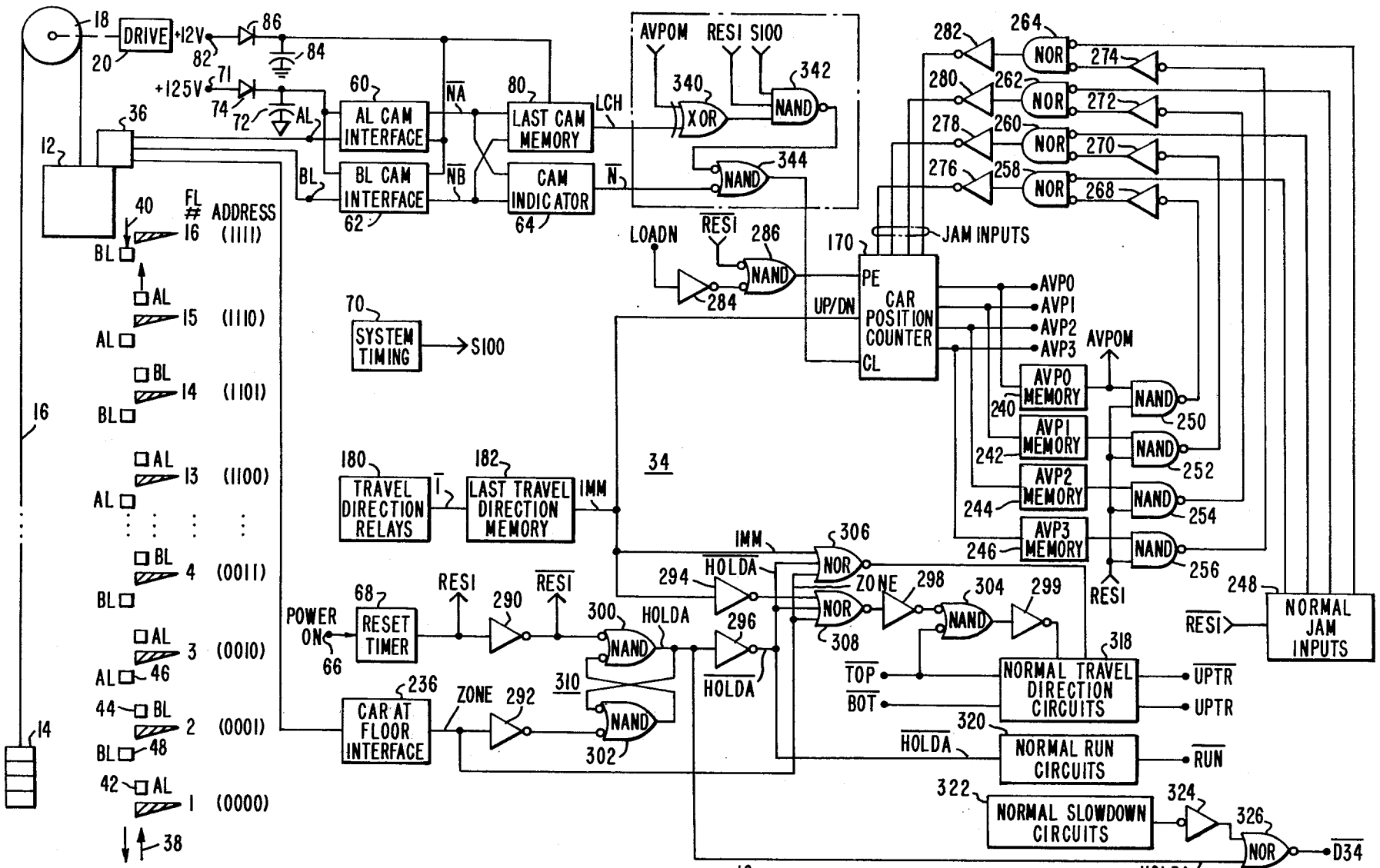
FIG. 1 is a partially schematic and partially block diagram of an elevator system constructed according to the teachings of the invention.

Referring now to the drawings and to FIG. 1 in particular, there is shown an elevator system of the traction type which is constructed according to the teachings of the invention. Elevator system 10 includes an elevator car 12 connected to a counterweight 14 via a suitable roping arrangement 16 which is reeved over a traction sheave 18. The elevator car 12 is suspended in the hatch or hoistway of a structure or building to serve a plurality of landings or floors therein. For purposes of example, it will be assumed that the building includes 16 floors, of which the first through the fourth, and the thirteenth through the sixteenth are illustrated. However, it is to be understood, that the invention applies to a building having any number of floors.

The traction sheave 18 is driven by a suitable drive 20, such as an A.C. or D.C. motor connected directly to the traction sheave, or to a suitable gear arrangement.

A floor selector 34 controls the elevator car 12. The floor selector 34 keeps track of the position of the elevator car 12 in the building and the calls for elevator service, and it generates the necessary signals to start the car and to stop it at the appropriate floors. In order to simplify the drawing, it will be assumed that the floor selector 34 is similar to the solid-state floor selector shown in the hereinbefore mentioned U.S. Pat. No. 3,750,850, with FIG. 1 illustrating how such a floor selector would be modified according to the teachings of the invention. Instead of utilizing a pulse wheel to generate distance pulses as the elevator car moves through the building, as in U.S. Pat. No. 3,750,850, indicia in the hoistway is detected by detectors mounted on the elevator car. The floor selector 34 is stepped or notched in response to indicators AL and BL disposed in the hoistway. While the invention is not limited to this arrangement of detecting car movement, it is a simple, low cost arrangement which is completely suitable for car speeds up to about 500 feet per minute. The indicia or hatch-mounted indicators may be cams for operating mechanical switches carried by the car, or, in order to eliminate the noise of such mechanical switches, permanent magnets and reed switches may be used in any desirable detector combination. The mechanical switches, or reed switches, are mounted on the elevator car 12 in a control panel shown generally at 36. The indicators AL and BL are disposed in different vertical lanes in the hoistway, and for purposes of example it will be assumed that there are four lanes, i.e., a lane of AL and BL indicators for each travel direction. When the floor selector 34 is set for uptravel it enables the AL and BL indicators disposed generally above arrow 38 in FIG. 1 to be detected, and when the floor selector is set for down travel it enables the AL and BL indicators disposed generally below arrow 40 to be detected. When an AL indicator has been detected while traveling in a predetermined direction, the selector then enables a BL indicator to be detected, and when a BL indicator is detected the selector then enables an AL indicator to be detected, etc., in order to prevent contact bounce from falsely notching the selector. If the elevator car 12 is at the first floor (binary address 0000), when it starts to move upwardly it will be set to detect an AL indicator in the AL up lane, which it will do almost immediately, detecting AL indicator 42. The resulting detection of the AL indicator 42 is used to advance or notch the floor selector 34 to indicate the elevator car is at the second floor (binary address 0001). When the elevator car leaves the second floor, the BL indicator 44 in the up BL lane is detected which notches the floor selector to the third floor (binary address 0010). If the elevator car should reverse at the third floor and start to travel downwardly, the AL indicator 46 in the down AL lane would notch the floor selector to the second floor, and when the elevator car leaves the second floor the BL indicator 48 in the down BL lane will notch the floor selector into the first floor. Thus, the AL indicators notch the floor selector into the even-numbered floors, and the BL indicators notch the floor selector into the odd-numbered floors, in either the up or down travel directions.

Slowdown cams and leveling cams (not shown) are also disposed in the hoistway, and when the floor selector 34 decides that a stop is to be made at a floor, and that the car is near the proper slowdown point, it will generate a signal $\overline{D34}$ which enables the slowdown and leveling cams to be detected.

The control 36 on the elevator car 12 provides a 125 volt D.C. signal AL when an AL cam is detected, and a 125 volt D.C. signal BL when a BL cam is detected. These signals are directed to the floor selector 34 over the traveling cables via AL and BL cam interfaces 60 and 62, respectively. These interfaces are 125 volt D.C. to logic level (12 volt) interfaces, with the AL interface 60 providing a true (logic zero) signal $\overline{NA}$ when the AL cam is detected. The BL interface 62 provides a true signal $\overline{NB}$ when the BL cam is detected. A cam indicator circuit 64 provides a true signal $\overline{N}$ each time a true signal $\overline{NA}$ or $\overline{NB}$ is received.

The AL cam and BL cam interfaces 60 and 62 are connected to a +125 volt source of direct current potential represented by terminal 71, and to a +12 volt source of direct current potential, represented by terminal 82. According to the teachings of the invention, a capacitor 72 is charged from the +125 volt source 71 via a diode 74 which prevents the capacitor from discharging back to the source when the source is interrupted. Capacitor 72 is sized to provide electrical energy for the AL and BL cam interfaces 60 and 62 for the maximum time during which the elevator car 12, when moving, will continue to move following an interruption in the source of electrical potential. Further, a capacitor 84 is charged from the +12 volt source 82 via a diode 86 which prevents capacitor 84 from discharging back to the source when the source is interrupted. The capacitor 84 is sized to provide electrical energy for the AL and BL cam interfaces 60 and 62, and for a last cam memory circuit 80.

The last cam memory circuit 80 is responsive to signals $\overline{NA}$ and $\overline{NB}$. The last cam memory circuit 80 provides a signal LCH which is at the logic one level if the last cam passed by the elevator car was an AL cam, and it is at the logic zero level when the last cam passed by the elevator car was a BL cam. This last cam memory circuit 80 is connected to the +12 volt source of electrical potential 82, and as hereinbefore stated, capacitor 84 provides electrical energy for the last cam memory 80 for the predetermined period of time it takes the elevator car to stop, should it be moving when the electrical power supply is interrupted.

Figure 2:
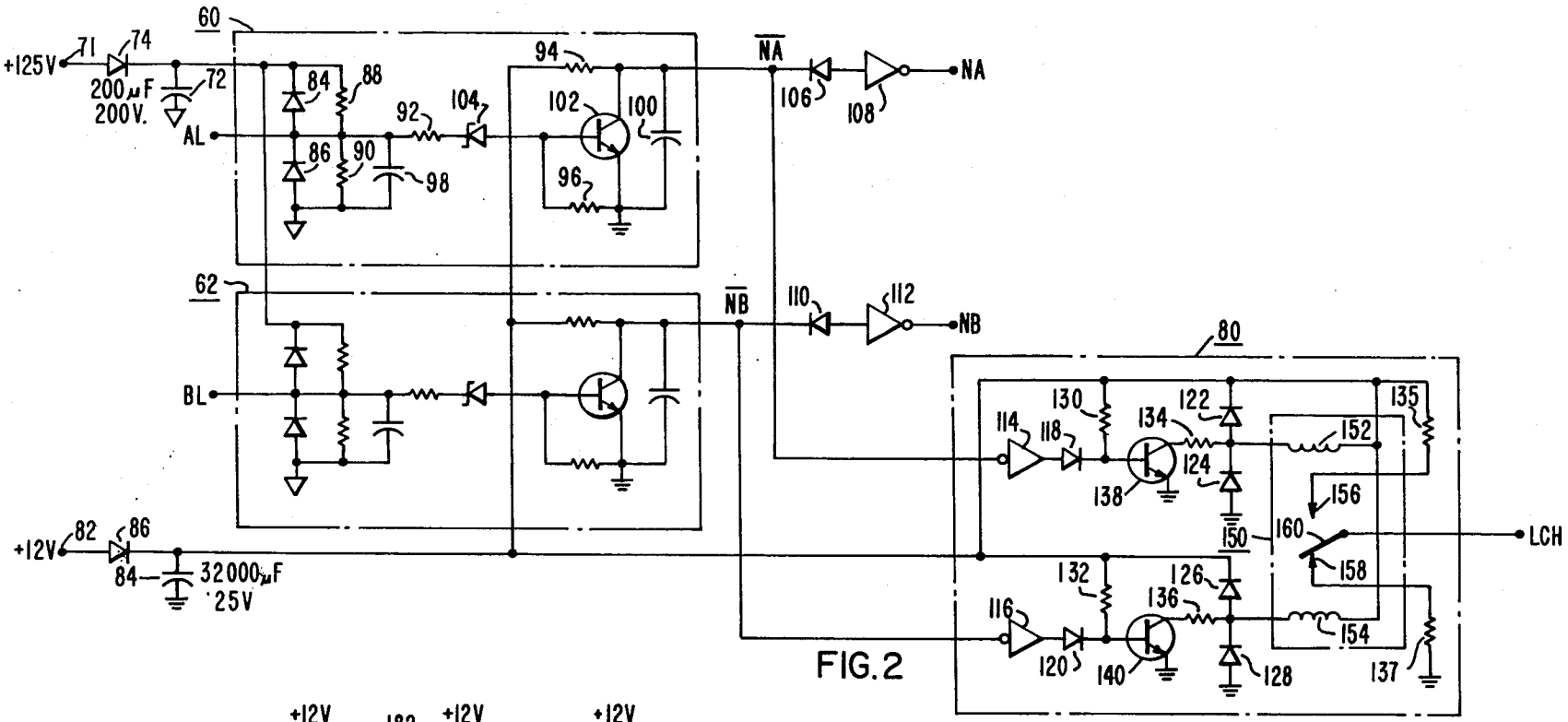
FIG. 2 is a schematic diagram of high voltage to logic voltage interface circuits and a memory element, which may be used for certain functions shown in block form in FIG. 1.

FIG. 2 is a schematic diagram of AL and BL cam interfaces 60 and 62, and last cam memory 80 which may be used for these functions shown in block form in FIG. 1. The AL cam interface 60 includes diodes 84 and 86, resistors 88, 90, 92, 94 and 96, capacitors 98 and 100, an NPN transistor 102, and a Zener diods 104. Input terminal AL is connected to the base of transistor 102 via resistor 92 and Zener diode 104. Terminal AL is also connected to the source of +125 volt potential via parallel connected diode 84 and resistor 88, and terminal AL is connected to power ground via parallel connected diods 86, resistor 90, and capacitor 98. The emitter of transistor 102 is connected to signal ground, resistor 96 interconnects the base and emitter electrodes of transistor 102, and the collector of transistor 102 is connected to the +12 volt source 82 via resistor 94. Capacitor 100 is connected across the collector and emitter electrodes of transistor 102. The collector of transistor 102 is connected to output terminal NA via diode 106 and NOT gate 108. Diode 106 is poled to prevent capacitor 84 from feeding circuits in the NOT gate 108 and other circuits connected thereto, during an interruption in the normal power supply.

The BL cam interface 62 is similar in construction to the AL cam interface, and will not be described in detail. The output of the BL cam interface is connected to an output terminal NB via an isolating diode 110 and a NOT gate 112.

The last cam memory 80 includes NOT gates 114 and 116, diodes 118, 120, 122, 124, 126 and 128, resistors 130, 132, 134, 135, 136 and 137, NPN transistors 138 and 140, and a bistable SPDT latching relay 150. The latching relay 150, which may be a Magnetcraft latching reed relay includes coils 152 and 154, stationary contacts 156 and 158, and a movable contact 160. Current through a coil of the latching relay actuates the movable contact to engage a stationary contact, and a permanent magnet holds this contact position without coil power until the other coil is energized.

Signal $\overline{NA}$ is connected to the base of NPN transistor 138 via NOT gate 114 and diode 118. The emitter of transistor 138 is connected to signal ground. The collector is connected to unidirectional source 82 via resistor 134 and coil 152 of the latching relay. Diodes 122 and 124 are serially connected between source 82 and signal ground. Their junction is connected to the junction between resistor 134 and coil 152. Resistor 135 is connected between source 82 and stationary contact 156 of relay 150.

Signal $\overline{NB}$ is connected to the base of NPN transistor 140 via NOT gate 116 and diode 120. The emitter of transistor 140 is connected to signal ground. The collector is connected to unidirectional source 82 via resistor 136 and coil 154 of the latching relay 150. Diodes 126 and 128 are serially connected between the source 82 and signal ground. Their junction is connected to the junction between resistor 136 and coil 154. Resistor 137 is connected between signal ground and the stationary contact 158 of the latching relay 150.

The movable contact 160 of the latching relay 150 is connected to an output terminal LCH which provides the signal LCH indicative of the last cam passed by the elevator car. When the elevator car passes cam AL signal $\overline{NA}$ goes low. The output of NOT gate 114 goes high to turn transistor 138 on and energize coil 152 to cause the movable contact 160 to engage stationary contact 156. Thus, terminal LCH is connected to source 82 via resistor 135 and signal LCH is a logic one. When the elevator car passes cam BL, signal $\overline{NB}$ goes low. The output of NOT gate 116 goes high, NPN transistor 140 conducts to energize coil 154, and movable contact 160 is switched to engage stationary contact 158. In this arrangement, terminal LCH is connected to signal ground, and thus signal LCH is a logic zero.

The position of the elevator car in the building is represented by a binary address signal AVPO–AVP3. This four bit binary signal is sufficient to discribe the position of the elevator car for 16 different points in the building, such as for 16 floors. If the building includes more than 16 floors, the car position signal would necessarily contain more than four bits. The car position signal is provided by a presettable up/down binary counter 170, illustrated in FIG. 1. Counter 170 includes a clock input CL, an up/down input UP/DN, a preset enable input PE, four jam inputs, and four outputs. A high (logic one) signal applied to the preset enable input PE loads the counter with the count which is applied to the jam inputs. When the UP/DN input is high the counter is enabled to count in the up direction, and when it is low it is enabled to count in the down direction. When the preset enable input PE is low, a signal applied to the clock input CL changes the count on the positive going transition of the signal.

Normally, the position counter has its UP/DN input connected to receive a signal responsive to the travel direction of the elevator car, the clock input CL is connected to receive the signal N, the preset enable input is responsive to a signal LOADN generated when the elevator car is at a terminal floor, and the normal jam inputs load the address of the terminal floor into the counter when the signal LOADN is true.

Before describing the modification of the present invention to the floor selector 34, certain other normal functions will be described. The signals are serial signals controlled by system timing shown generally at 70. The system timing is explained in detail in U.S. Pat. No. 3,750,850. For purposes of this application, it is sufficient to note that system timing 70 provides a timing signal S100 which is true only during the first scan slot of each scan slot cycle. The timing generates a plurality of scan slots in each scan slot cycle, such as 16, with each floor of the building being associated with a predetermined different scan slot.

When the floor selector 34 determines the travel direction of the elevator car, it generates a signal UPTR which is a logic one when the selector travel direction is up, and a logic zero when it is down. Signal UPTR sets the up and down travel direction relays 1 and 2, respectively, shown generally at 180. According to the teachings of the invention, the travel direction is "memorized" by a suitable memory element 182, such that the travel direction existing at the time of a power interruption is retained. The output signal 1MM of the travel direction memory is a logic one when the travel direction is up, and a logic zero when it is down. Signal 1MM is connected to the UP/DN input of the car position counter 170.

Figure 3:
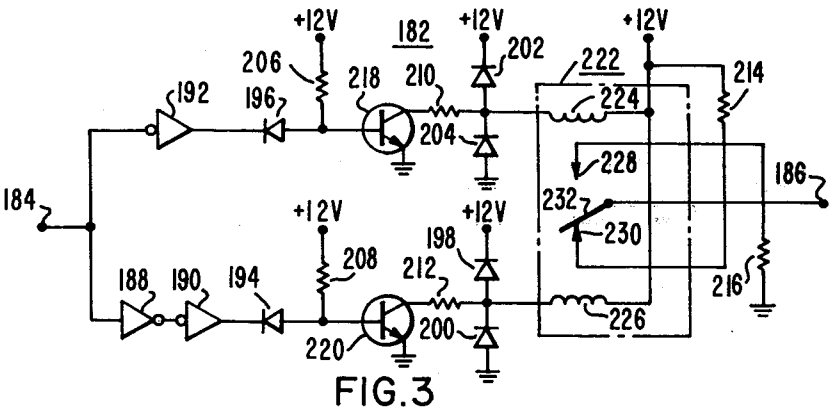
FIG. 3 is a schematic diagram of a memory element which may be used for still other memory devices shown in block form in FIG. 1.

FIG. 3 is a schematic diagram of a memory element 182 which may be used for the last travel direction memory 182 shown in block form in FIG. 1. Memory 182 includes an input terminal 184, and output terminal 186, NOT gates 188, 190, and 192, diodes 194, 196, 198, 200, 202, and 204, resistors 206, 208, 210, 212, 214 and 216, NPN transistors 218 and 220, and a latching relay 222. Latching relay 222 may be similar to the latching relay 150 shown in FIG. 2, having coils 224 and 226, stationary contacts 228 and 230, and a movable contact 232. Input terminal 184 is connected to the base of transistor 218 via NOT gate 192 and diode 196. The base of transistor 218 is connected to a +12 volt source of electrical potential via resistor 206. The emitter of transistor 218 is connected to signal ground. The collector of transistor 218 is connected to a +12 volt source of electrical potential via resistor 210 and coil 224 of the latching relay 222. Diodes 202 and 204 are serially connected between a +12 volt source and signal ground, and the junction of these two diodes is connected to the junction between resistor 210 and coil 224.

Input terminal 184 is also connected to the base of transistor 220 via NOT gates 188 and 190 and diode 194. The base is connected to a +12 volt source via resistor 208, the emitter is connected to signal ground, and the collector is connected to a +12 volt source via resistor 212 and coil 226. Diodes 198 and 200 are serially connected between the +12 volt source and signal ground, with the junction between these two diodes being connected to the junction between resistor 212 and coil 226. Stationary contact 228 is connected to signal ground via resistor 216, and stationary contact 230 is connected to the +12 volt source via resistor 214. The movable contact 232 is connected to output terminal 186.

If a signal is applied to input terminal 184 which is at the logic one level, transistor 220 will be turned on to energize coil 226 and cause movable contact 232 to engage stationary contact 230. Thus, the output terminal 186 is connected to the +12 volt source and the output terminal 186 is at the logic one level. When the signal applied to input terminal 184 is at the logic zero level, transistor 218 will be turned on, energizing coil 224 and causing the movable contact 232 to engage stationary contact 228. Output terminal 186 is thus connected to signal ground, and the logic level of the output terminal 186 is zero.

Returning now to FIG. 1, when power is first applied to the floor selector 34, and each time it is reapplied after an interruption of the power supply, a power-on signal is applied to a terminal 66 which starts a reset timer 68. The reset timer 68 provides a RESET signal RES1 which goes high for a predetermined period of time and then it does low.

A 125 volt to logic level interface 236 provides a true signal ZONE (logic one) when the elevator car is stopping at a floor and is within 2 inches of floor level. The signal remains true until the car leaves the floor. The signal for the "car at the floor" interface 236 is provided by a detector in the control 36 mounted on the elevator car.

The car position signal AVPO–AVP3 is memorized by memory elements 240, 242, 244 and 246, with the memory element shown in detail in FIG. 3 being suitable for each of these memory elements. The memorized car position signal, referred to as AVPOM–AVP3M is OR'ed with the normal jam inputs, shown generally at 248, and these normal jam input signals are applied to the jam inputs of the car position counter 170. When the elevator car is located at a terminal, the terminal address is loaded into the counter 170. When power is interrupted, and then it returns, the memorized car position signal AVPOM–AVP3M is loaded into the counter. The OR'ing may be accomplished by NAND gates 250, 252, 254 and 256, NOR gates 258, 260, 262 and 264, NOT gates 268, 270, 272, 274, 276, 278, 280 and 282, and RESET signals RES1 and $\overline{\text{RES1}}$. The preset enable input PE of counter 170 is connected to receive the LOADN and RES1 signals via a NOT gate 284 and a dual input NAND gate 286. The LOADN signal is connected to one input of NAND gate 286 via the NOT gate 284, and the reset signal RES1 is connected to the other input. Thus, if the car is at a terminal floor, signal LOADN will go high and NAND gate 286 will apply a logic one to the preset enable input PE to load the jam inputs into the counter. If the reset signal $\overline{\text{RES1}}$ is true (low), the output of NAND gate 286 also goes low to load the jam inputs.

Signal $\overline{\text{RES1}}$ is connected to the normal jam inputs 248, inhibiting them when $\overline{\text{RES1}}$ is true (low). The outputs of memory elements 240, 242, 244 and 246 are connected to NAND gates 250, 252, 254 and 256, respectively, and signal RES1 is connected to the remaining inputs. Thus, if a memory element is providing a logic one signal when RES1 is true 170. (high) its associated NAND gate will output a logic zero, and if the memory element is providing a logic zero, its associated NAND gate will output a logic one. The output of NAND gates 250, 252, 254 and 256 are connected to inputs or NOR gates 258, 260, 262, 264 and via NOT gates 268, 270, 272 and 274, respectively. The remaining inputs of NOR gates 258, 260, 262 and 264 are connected to receive the normal jam inputs 248. Thus, if the car is located at a terminal floor, a true LOADN signal will load the counter with the address of the terminal floor. If the power has just been applied to the control circuits, the memorized car position signal AVPOM–AVP3M will be loaded into the car position counter 170.

If electrical power is interrupted when the elevator car is located at a floor, the memorized travel direction and memorized car position will immediately reset the car position counter 170 when power returns, and the elevator car will be ready to answer calls. If the car is not at a floor when power is interrupted, its car position counter will be reset when power returns, the travel direction signal UPTR will be set according to the memorized last travel direction, which in turn energizes the appropriate travel direction relay 1 or 2, (1 = up; 2 = down), shown generally at 180, the car is set to run at landing speed in the memorized travel direction, and it is stopped at the first floor that it comes to in this travel direction. These functions are provided by NOT gates 290, 292, 294, 296, 298 and 299, NAND gates 300, 302 and 304, NOR gates 306 and 308, and switches in the hatch which provide a signal $\overline{\text{TOP}}$ when the car reaches the upper terminal and a signal $\overline{\text{BOT}}$ when the car reaches the lower terminal.

NAND gates 300 and 302 are connected to provide a flip flop 310 with the signal RES1 being connected to one input of the flip flop via NOT gate 290, and with the signal ZONE being connected to the other input via NOT gate 292. When power is applied or returns following an interruption, signal RES1 goes high for a predetermined period of time, which signal is inverted by NOT gate 290 to force the output of NAND gate 300 high. This output is referred to as signal HOLDA. If the car is at a floor, the signal ZONE will be a logic one and when signal RES1 goes low at the end of the predetermined time, signal HOLDA will go low. If the car is not at a floor when power returns, the signal ZONE will be low, and the NOT gate 292 applies a logic one signal to NAND gate 302. NAND gate 302 applies a logic zero signal to NAND gate 300 to hold NAND gate in the same state notwithstanding signal RES1 going low. Thus, signal HOLDA will be high and and it will remain high until the car reaches a floor and the signal ZONE goes high. If the car is not at a floor (ZONE = 0), when signal $\overline{\text{HOLDA}}$ is true (zero) and the memorized travel direction was down (1MM = 0), NOR gate 306 will provide a logic one to set the normal travel direction circuits for down travel (UPTR = 0). If the memorized travel direction was up, NOR gate 308 will apply a logic one to the travel direction circuits via NOT gate 298, NAND gate 304 and NOT gate 299, and set the travel direction for UP, unless the car was at the upper terminal ($\overline{\text{TOP}}$ = 0), in which case signal $\overline{\text{TOP}}$ will cause a logic zero to be applied to the normal travel direction circuits.

The signal $\overline{\text{HOLDA}}$, when true, (low) sets the normal run circuits 320 to provide a true signal $\overline{\text{RUN}}$ which initiates the sequence for starting the elevator car. The signal $\overline{\text{HOLDA}}$ also forces a true $\overline{\text{D34}}$ signal such that the elevator car will stop at the first floor that it comes to. The output of the normal slowdown circuits 322, which provides the low or true $\overline{\text{D34}}$ signal is connected to the $\overline{\text{D34}}$ terminal via NOT gate 324 and NOR gate 326. The other input of NOR gate 326 is connected to receive the signal HOLDA. Thus, a low output from the normal slowdown circuit 322 provides a low $\overline{\text{D34}}$ signal, as does a high signal HOLDA. The $\overline{\text{D34}}$ signal enables the car to "see" the slowdown and leveling cams.

The last cam memory 80 indicates by its signal LCH whether the last cam passed by the elevator car was an AL or a BL cam. If signal LCH is a logic one, the last cam was the AL cam, and if it is a logic zero, the last cam was a BL cam. If the car position counter is changed each time a cam is passed, the least significant bit AVPOM of the car position address will be at the same logic level as signal LCH. This is true because the BL cams notch the selector into the odd numbered floors, and the signal AVPO is zero for the odd numbered floors, while the AL cams notch the selector into the even numbered floors and the AVPO bit is a logic one for the even numbered floors. Table I illustrates the car position versus the last cam passed, with the car position being illustrated for 16 floors by the binary car position signal AVPO–AVP3.

TABLE I

| CAR POSITION VS. LAST CAM PASSED FLOOR # | | | | | | | | | | | | | | | | |
|---|---|---|---|---|---|---|---|---|---|---|---|---|---|---|---|---|
| CAR POSITION BITS | 1 | 2 | 3 | 4 | 5 | 6 | 7 | 8 | 9 | 10 | 11 | 12 | 13 | 14 | 15 | 16 |
| AVP0 | 0 | 1 | 0 | 1 | 0 | 1 | 0 | 1 | 0 | 1 | 0 | 1 | 0 | 1 | 0 | 1 |
| AVP1 | 0 | 0 | 1 | 1 | 0 | 0 | 1 | 1 | 0 | 0 | 1 | 1 | 0 | 0 | 1 | 1 |
| AVP2 | 0 | 0 | 0 | 0 | 1 | 1 | 1 | 1 | 0 | 0 | 0 | 0 | 1 | 1 | 1 | 1 |
| AVP3 | 0 | 0 | 0 | 0 | 0 | 0 | 0 | 0 | 1 | 1 | 1 | 1 | 1 | 1 | 1 | 1 |
| LCH | 0 | 1 | 0 | 1 | 0 | 1 | 0 | 1 | 0 | 1 | 0 | 1 | 0 | 1 | 0 | 1 |

LCH = 1 IF AL IS THE LAST CAM PASSED BY THE CAR
LCH = 0 IF BL IS THE LAST CAM PASSED BY THE CAR

If the elevator car is moving when power is interrupted, and it moves past a cam before the car stops, the last cam memory will note the type of cam, but the car position counter 170 will not be changed by this cam. It is impractical to maintain the car position counter active with capacitor storage energy, because the amount of capacitance required would be prohibitively large. When power returns, following an interruption, the memorized least significant car position bit AVPOM is compared with signal LCH in an XOR gate 340. If both inputs to XOR gate 340 are the same, its output will be zero, indicating the selector is in step. If the inputs are different, the output of the XOR gate 340 will be a logic one, indicating the selector is out of step. The truth table for XOR gate 340 is illustrated in Table II below:

TABLE II

| LCH | AVPOM | OUTPUT OF XOR 340 | |
|---|---|---|---|
| 0 | 0 | 0 | Selector is in step |
| 1 | 1 | 0 | |
| 0 | 1 | 1 | Selector is out of step |
| 1 | 0 | 1 | |

The output of the XOR gate 340 is applied to an input of a 3-input NAND gate 342. The timing signal S100 and the reset signal RES1 are applied to the other two inputs. The output of NAND gate 342 is applied to an input of a dual input NAND gate 344. The other input is connected to receive signal $\overline{N}$ from the cam indicator 64. The output of NAND gate 344 is connected to the clock input CL of the car position counter 170. When the selector 34 is in step, NAND gate 342 applies a logic one to NAND gate 344 allowing the normal $\overline{N}$ signals to be applied to counter 170. If the selector 34 is out of step, a high RES1 signal causes NAND gate 342 to output a logic zero during time S100 and NAND gate 344 applies a logic one signal to counter 170 to advance the counter one count in the direction of the memorized travel direction. The AVPOM bit will then change to correspond to the logic level of signal LCH and the output of NAND gate 342 will return to a logic one to enable NAND gate 344 to pass the normal $\overline{N}$ signals.

In summary, the present invention is a new improved elevator system in which the floor selector may be correctly and immediately reset following power return after an interruption thereof. If the car is already at a floor, it will be immediately ready to answer calls, and if it is not at a floor, it will proceed at landing speed in its last travel direction, and it will stop at the first floor that it comes to. Electrical energy sufficient to recognize and store an indication of car movement following an interruption of the power supply is provided by low cost capacitors, eliminating the need for batteries, or the need for running the elevator car to a terminal floor. The capacitors are charged and ready to provide power for selected circuits of the floor selector, with only two capacitors being required in the embodiment of the invention set forth herein for purposes of example. For an elevator car which will slide for a maximum of 3 seconds following a power interruption, it has been determined that the capacitor 72 may be a 200 microfarad capacitor rated at 200 volts, and capacitor 84 may be a 32,000 microfarad capacitor rated 25 volts.

We claim as our invention:

1. An elevator system, comprising:

a building having a plurality of floors, an elevator car mounted for movement in said building to serve the floors therein, car position means providing a signal indicative of the position of said elevator car in the building, detector means responsive to movement of said elevator car for updating said car position means, first memory means responsive to said detector means for retaining the latest indication of movement of said elevator car, an electrical power supply for said car position means, said detector means and said first memory means, capacitor means charged by said electrical power supply means, said capacitor means being connected to operate said detector means and said first memory means for a predetermined period of time following interruption of said electrical power supply, said predetermined period of time being at least as long as it takes for the elevator car, when moving, to come to a stop following an interruption of said electrical power supply, and comparison means responsive to said car position means and to said first memory means, said comparison means providing an out-of-step signal following the return of the electrical power supply after interruption thereof when the first memory means indicates predetermined movement of the elevator car occurred following such interruption.

2. The elevator system of claim 1 including travel direction memory means which indicates the travel direction of the elevator car at the time of interruption in the electrical power supply, with the car position means being responsive to an out-of-step signal when provided by the comparison means and to said travel direction memory means, to correct its car position signal.

3. The elevator system of claim 1 wherein the car position means includes a counter and car position memory means which stores the count of said counter which exists at the time of an interruption in the electrical power supply, said car position memory means loading said counter with the stored count upon return of the electrical power supply following an interruption thereof.

4. The elevator system of claim 3 including travel direction memory means which indicates the travel direction of the elevator car at the time of an interruption of the electrical power supply, said car position means being responsive to an out-of-step signal when provided by the comparison means to change the count of the counter in the proper direction to correctly indicate the position of the elevator car.

5. An elevator system, comprising:

a building having a plurality of floors, an elevator car mounted for movement in said building to serve the floors therein, car position means providing a signal indicative of the position of said elevator car in the building, said car position means including a counter and car position memory means responsive thereto which stores the latest count of said counter, said car position memory means loading the stored count into said counter upon return of the electrical power supply following an interruption thereof, detector means responsive to movement of said elevator car for updating said car position means, first memory means responsive to said detector means for retaining the latest indication of movement of said elevator car, an electrical power supply for said car position means, said detector means and said first memory means, capacitor means charged by said electrical power supply means, said capacitor means being connected to operate said detector means and said first memory means for a predetermined period of time following interruption of said electrical power supply, said predetermined period of time being at least as long as it takes for the elevator car, when moving, to come to a stop following an interruption of said electrical power supply, the count of said counter and the indication of said first memory means having a predetermined relationship when the detector means has correctly updated the car position means, and comparison means responsive to said counter and to the first memory means, providing an out-of-step signal when said predetermined relationship does not exist.

6. The elevator system of claim 5 including travel direction memory means which indicates the travel direction of the elevator car at the time of an interruption of the electrical power supply, with the car position means being responsive to an out-of-step signal when provided by the comparison means and to said travel direction memory means to correct the count of the counter in the proper direction.

7. An elevator system, comprising:

a building having a plurality of floors, an elevator car mounted for movement in said building to serve the floors therein, car position means providing a signal indicative of the position of said elevator car in the building, detector means responsive to movement of said elevator car for updating said car position means, first memory means responsive to said detector means for retaining the latest indication of movement of said elevator car, an electrical power supply for said car position means, said detector means and said first memory means, capacitor means charged by said electrical power supply means, said capacitor means being connected to operate said detector means and said first memory means for a predetermined period of time following interruption of said electrical power supply, said predetermined period of time being at least as long as it takes for the elevator car, when moving, to come to a stop following an interruption of said electrical power supply, travel direction memory means, reset means, said reset means providing a reset signal for a predetermined period of time following return of the electrical power supply means after an interruption thereof, and means responsive to said reset signal and said travel direction memory means for causing the elevator car, when it is not at a floor, to run and stop at the closest floor in the travel direction indicated by said travel direction memory means.

* * * * *